US009051681B1

(12) United States Patent
Costa

(10) Patent No.: US 9,051,681 B1
(45) Date of Patent: Jun. 9, 2015

(54) METHOD OF FOLDING AND WEARING A POCKET SQUARE TO DISPLAY INSIGNIA, CAMPAIGN RIBBON, ICON, BADGE, AWARD, OR MEDAL

(71) Applicant: Christopher Costa, Clifton, NJ (US)

(72) Inventor: Christopher Costa, Clifton, NJ (US)

( * ) Notice: Subject to any disclaimer, the term of this patent is extended or adjusted under 35 U.S.C. 154(b) by 0 days.

(21) Appl. No.: 14/210,566

(22) Filed: Mar. 14, 2014

(51) Int. Cl.
*D06F 89/02* (2006.01)
*A41B 15/02* (2006.01)
*A41D 27/20* (2006.01)

(52) U.S. Cl.
CPC ..... *D06F 89/02* (2013.01)

(58) Field of Classification Search
CPC ..... D06F 89/00; D06F 89/02; D06F 89/023; D06F 89/026; B65D 85/18; B65D 85/102; A41D 15/00; A41D 23/00; A41D 27/20; A41D 23/201
USPC ..... 223/37; 2/279, 201, 247; D2/500, 502, D2/503, 508; 40/124.06
See application file for complete search history.

(56) References Cited

U.S. PATENT DOCUMENTS

| | | | | | |
|---|---|---|---|---|---|
| 1,185,767 | A | * | 6/1916 | Cather et al. | 229/75 |
| 1,785,962 | A | * | 12/1930 | Line | 2/279 |
| 2,117,465 | A | * | 5/1938 | Tully | 2/250 |
| 2,200,601 | A | * | 5/1940 | Grunwald | 223/111 |
| D121,695 | S | * | 7/1940 | Palmer | D2/502 |
| 2,909,785 | A | * | 10/1959 | Mysels | 2/279 |
| 3,026,532 | A | * | 3/1962 | Janz | 2/279 |
| 4,771,502 | A | * | 9/1988 | Trimble | 15/209.1 |
| 6,510,629 | B1 | * | 1/2003 | Smidt et al. | 40/1.5 |

* cited by examiner

*Primary Examiner* — Ismael Izaguirre
(74) *Attorney, Agent, or Firm* — Michael J. Feigin, Esq.; Feigin & Associates, LLC

(57) ABSTRACT

Embodiments of the disclosed technology are directed to a pocket square and/or methods of folding and displaying a pocket square in a customized manner. The piece of fabric employed may be of any size or design. In embodiments, the fabric has a design, which, when folded and displayed according to the disclosed method, gives a customized appearance. The customized appearance may be, for example, a replication of an insignia, ribbon, icon, medal, rank or badge worn by a service man or woman. The appearance may also be of a flag, club, fraternity, team, or other insignia that one may desire to display. In embodiments, the same piece of fabric may be used to form different design configurations and/or layouts.

9 Claims, 5 Drawing Sheets

METHOD OF FOLDING AND WEARING A POCKET SQUARE TO DISPLAY INSIGNIA, CAMPAIGN RIBBON, ICON, BADGE, AWARD, OR MEDAL

FIELD OF THE DISCLOSED TECHNOLOGY

The disclosed technology relates generally to apparel accessories, and more particularly to using and displaying a custom pocket square.

BACKGROUND OF THE DISCLOSED TECHNOLOGY

Appearance of formal wear continues to be an important part of presenting oneself in an occupational or special occasional setting. Neckties are worn in various environments from weddings and social events to job interviews and business meetings. Often accompanying a necktie is a pocket square worn in the suit jacket pocket of the wearer. The pocket square may match the wearer's necktie or shirt color, thereby giving the wearer a more refined and formal appearance. While most pocket squares serve the purpose of an easy and fancy accessory to a suit, they usually serve no further purpose.

Thus, needed in the art are pocket squares and methods for displaying an insignia, campaign ribbon, icon, logo, medal, award or badge that indicates or expresses something about the wearer.

SUMMARY OF THE DISCLOSED TECHNOLOGY

Therefore, it is an object of the disclosed technology to provide a method of folding a pocket square such that a particular insignia of the pocket square is displayed when worn.

In an embodiment of the disclosed technology, a method is used for folding and donning a pocket square using a square piece of a material. The method is carried out, not necessarily in the following order, by: a) folding a first vertical crease in the piece of material wherein the crease is approximately one-third of a width of the piece of material from a first vertical edge of the piece of material; b) folding a second vertical crease in the piece of material wherein the second crease is approximately two-thirds of the width of the piece of material from the first vertical edge of the piece of material; c) folding a first horizontal crease in the piece of material wherein the first horizontal crease is between one-fourth and one-half of a distance from a bottom edge to a top edge of the piece of material; and d) placing the piece of material in a pocket of a jacket or shirt such that an exposed portion of the piece of material protrudes from the pocket.

In a further embodiment, the piece of material is placed in the jacket, sport coat or suit such that an exposed portion of the piece of material resembles a badge, medal, ribbon, icon, or award worn by a service person. Furthermore, the first horizontal crease may be formed based on a depth of the pocket. Still further, the piece of material may have a design that is displayed on the exposed portion of the piece of material. Alternatively, the piece of material may have multiple symbols which are selectively displayed based on the method of folding. Still further, the piece of material may have four identical symbols, of which any number is selectively displayed based on the method of folding.

In another embodiment of the disclosed technology, a method is used for donning a pocket square. The method is carried out, not necessarily in the following order, by: a) laying out a rectangular, or square fabric, the fabric having a front face, a back face, a top edge, a bottom edge, a left edge, a right edge and a design adorning at least an uppermost portion of the front face or the back face of the fabric; b) folding the left edge to a central vertical axis on the front face of the fabric; c) folding the right edge to the central vertical axis on the front face of the fabric such that the right edge meets the left edge; d) folding the fabric along the central vertical axis; e) folding the fabric along a horizontal axis; and f) placing the fabric in a pocket of a jacket, sport coat or shirt.

In a further embodiment of the disclosed method, the horizontal axis is a central horizontal axis. Still further, an exposed portion of the fabric displays the design.

It should be understood that the use of "and/or" is defined inclusively such that the term "a and/or b" should be read to include the sets: "a and b," "a or b," "a," "b." Further details are set forth in the detailed description below.

DETAILED DESCRIPTION OF EMBODIMENTS OF THE DISCLOSED TECHNOLOGY

Embodiments of the disclosed technology are directed to a pocket square and/or methods of folding and displaying a pocket square in a customized manner. The piece of fabric employed may be of any size or design. In embodiments, the fabric has a design, which, when folded and displayed according to the disclosed method, gives a customized appearance.

The customized appearance may be, for example, a replication of an insignia, ribbon, icon, logo, medal, award or rank badge worn by an active or inactive service man or woman. The appearance may also be of a flag, club, fraternity, team, or other insignia that one may desire to display. In embodiments, the same piece of fabric may be used to form different design configurations and/or layouts.

Embodiments of the disclosed technology will become clearer in view of the following description of the Figures.

Figure 1:
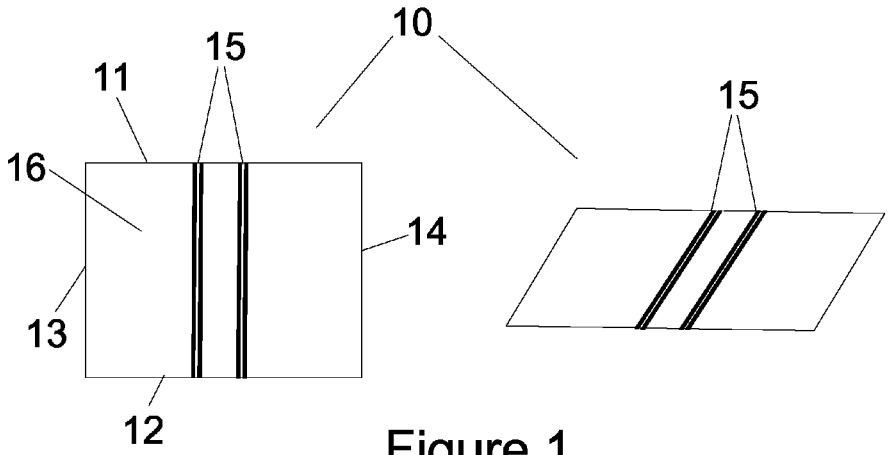
FIG. 1 shows a top view and a perspective view of an unfolded pocket square according to embodiments of the disclosed technology.

FIGS. 1 through 4 show top and perspective views illustrating steps taken in folding a pocket square using a three-column method according to embodiments of the disclosed technology. FIG. 1 shows a top view and a perspective view of an unfolded pocket square according to embodiments of the disclosed technology. The pocket square 10 may be formed of any type of flexible material or fabric. Further, the pocket square 10 may be a rectangle or a square having any size and/or dimensions. FIG. 1 shows a top view and a perspective view of an unfolded pocket square 10 according to embodiments of the disclosed technology.

The pocket square 10 has narrow stripes 15 which may be representative of a service ranking, ribbon and/or insignia. The arrangement in which the pocket square 10 is folded may give meaning and symbolism to stripes 15. Referring still to FIG. 1, the pocket square 10 may be generally described as having a top edge 11, a bottom edge 12, a left edge 13 and right edge 14. Further, the front face 16 of the pocket square 10 is shown, while an opposing backside 17 is not viewable in FIG. 1.

Figure 2:
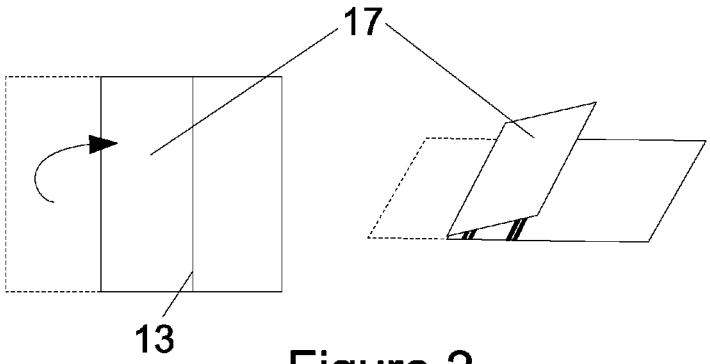
FIG. 2 shows a top view and a perspective view illustrating a first step taken in folding a pocket square using a three-column method according to embodiments of the disclosed technology.
Figure 3:
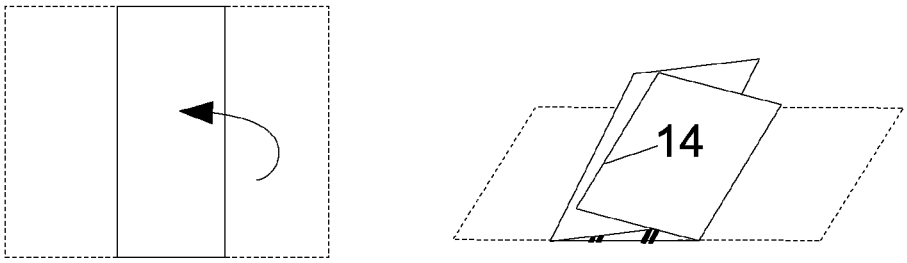
FIG. 3 shows a top view and a perspective view illustrating a second step taken in folding a pocket square using a three-column method according to embodiments of the disclosed technology.

FIG. 2 shows a top view and a perspective view illustrating a first step taken in folding a pocket square using a three-column method according to embodiments of the disclosed technology. In the first step(s) of the three-column method, the pocket square 10 is laid out flat, and the first edge 13 is lifted and folded onto the front face 16. A vertical crease is made at approximately one-third of the distance from the left edge 13 to the right edge 14. The back face 17 of the pocket square is visible in FIG. 2. FIG. 3 shows a top view and a perspective view illustrating a second step taken in folding a pocket square using a three-column method according to embodiments of the disclosed technology. Thus, in FIG. 3, the right edge 14 is folded onto front face 16. Thus, in FIG. 3, the pocket square 10 is three layers thick.

Figure 4:
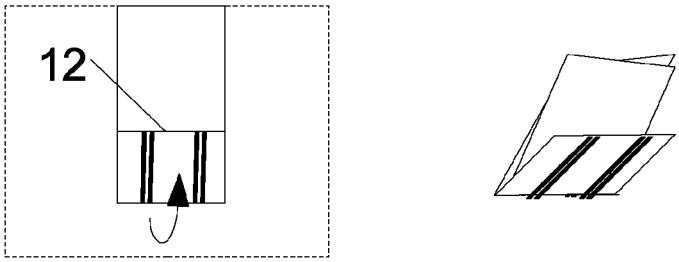
FIG. 4 shows a top view and a perspective view illustrating a third step taken in folding a pocket square using a three-column method according to embodiments of the disclosed technology.

FIG. 4 shows a top view and a perspective view illustrating a third step taken in folding a pocket square using a three-column method according to embodiments of the disclosed technology. In this step, the bottom edge 12 is folded up to make a crease approximately one-fourth to one-third of the distance from the bottom edge 12 to the top edge 11. The location of this crease may vary based on: a) the size of the pocket square 10; b) the depth of a pocket in which the pocket square will be worm; and c) the desired height of the visible portion of the pocket square when positioned in the pocket. It shall be noted that the pocket square 10 should be turned over from the position shown in FIG. 4 before insertion into the pocket in order to display the narrow stripes 15. Furthermore, the location of this crease may vary based on the option of inserting pocket square 10 into the pocket a). when inserted into the pocket the wearer may view the 3 or 4 layers from the most vertical view, or b.) when inserted into the pocket the wearer may view only one horizontal crease from the vertical view.

Figure 5:
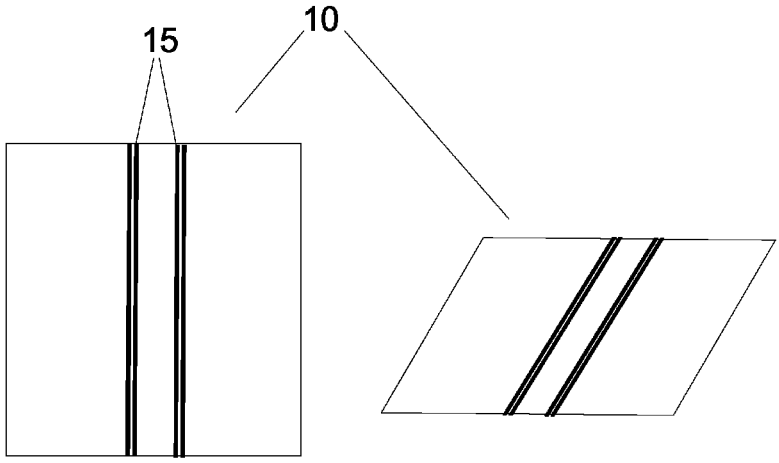
FIG. 5 shows a top view and a perspective view of another unfolded pocket square according to embodiments of the disclosed technology.

FIGS. 5 through 9 show top and perspective views illustrating steps taken in folding a pocket square using a four-column method according to embodiments of the disclosed technology. FIG. 5 shows a top view and a perspective view of another unfolded pocket square according to embodiments of the disclosed technology. The pocket square 10 has narrow stripes 15 which may be representative of a service ranking, ribbon, medal and/or insignia. In this embodiment, the pocket square 10 may be taller, thicker and wider than that shown in FIGS. 1 through 4. This is because the pocket square is folded in a four-column configuration as opposed to a three-column configuration. As such, the method depicted in FIGS. 5 through 9 may be used with a larger or over-sized piece of fabric that may not have been originally meant to be used as a pocket square. Such may be the case with a small flag, bandana, or other tapestry.

Figure 6:
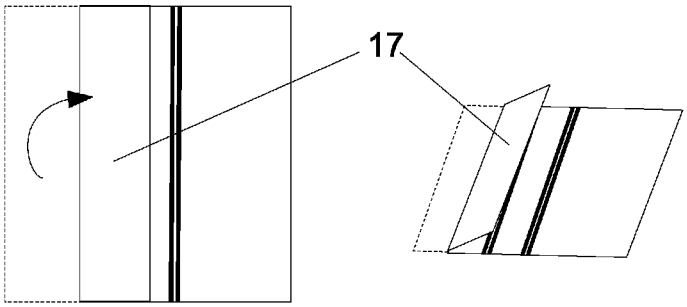
FIG. 6 shows a top view and a perspective view illustrating a first step taken in folding the pocket square of FIG. 5 using a four-column method according to embodiments of the disclosed technology.

FIG. 6 shows a top view and a perspective view illustrating a first step taken in folding the pocket square of FIG. 5 using a four-column method according to embodiments of the disclosed technology. In the first step(s) of the four-column method, the pocket square 10 is laid out flat, and the first edge 13 is lifted and folded onto the front face 16. A vertical crease is made at approximately one-fourth of the distance from the left edge 13 to the right edge 14. The back face 17 of the pocket square is visible in FIG. 2.

Figure 7:
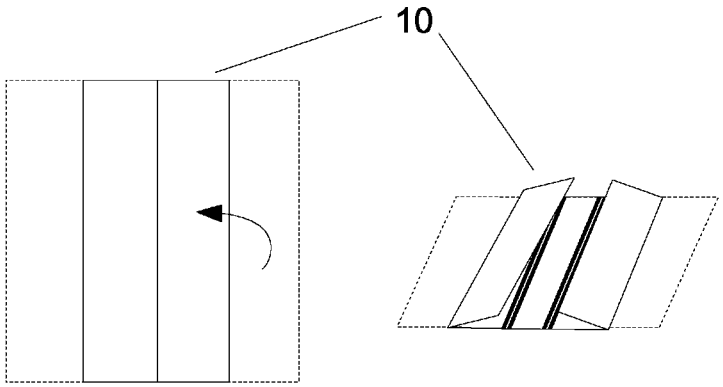
FIG. 7 shows a top view and a perspective view illustrating a second step taken in folding the pocket square of FIG. 5 using a four-column method according to embodiments of the disclosed technology.

FIG. 7 shows a top view and a perspective view illustrating a second step taken in folding the pocket square of FIG. 5 using a four-column method according to embodiments of the disclosed technology. Thus in FIG. 7, the right edge 14 is folded onto front face 16 to form a crease approximately one-fourth of the way between the right edge 14 and the left edge 13.

Figure 8:
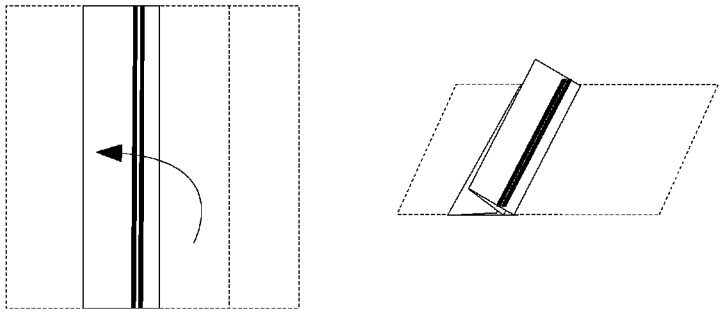
FIG. 8 shows a top view and a perspective view illustrating a third step taken in folding the pocket square of FIG. 5 using a four-column method according to embodiments of the disclosed technology.

FIG. 8 shows a top view and a perspective view illustrating a third step taken in folding the pocket square of FIG. 5 using a four-column method according to embodiments of the disclosed technology. Thus, in FIG. 8, the pocket square 10 is folded in half along a central vertical axis. Thus, after FIG. 8, the pocket square 10 is four layers thick. The back face 17 of the pocket square 10 with a set of narrow stripes 15 is visible in this view. The pocket square 10 is then inserted into a jacket pocket for use.

Figure 9:
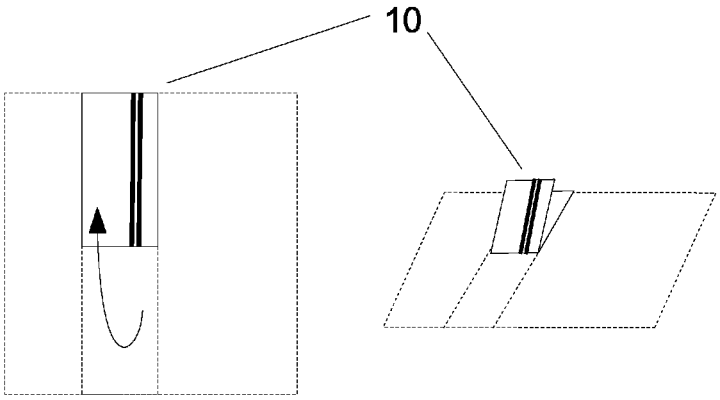
FIG. 9 shows a top view and a perspective view illustrating a fourth step taken in folding the pocket square of FIG. 5 using a four-column method according to embodiments of the disclosed technology.

FIG. 9 shows a top view and a perspective view illustrating a fourth step taken in folding the pocket square of FIG. 5 using a four-column method according to embodiments of the disclosed technology. In this step, the pocket square 10 is folded along a central horizontal axis such that the bottom edge 12 meets the top edge 11.

Figure 10:
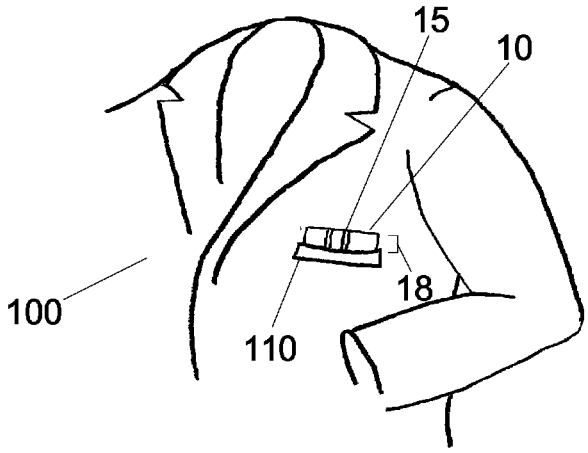
FIG. 10 shows folded pocket square being worn in accordance with an embodiment of the disclosed technology.

FIG. 10 shows folded pocket square being worn in accordance with an embodiment of the disclosed technology. The jacket 100 may be a suit jacket, sport coat, tuxedo jacket, etc. The jacket 100 has at least one pocket 110 on a breast portion thereof. The folded pocket square 10 of either FIG. 4 or FIG. 9 may be placed into the pocket such that the stripe or stripes 15 are displayed on the visible portion 18 of the pocket square. The final crease made along a horizontal axis may be adjusted to preference to in turn adjust the height of the exposed portion 18 of the pocket square 10. As depicted, the exposed portion 18 the pocket square 10 resembles a badge, ribbon, medal or ranking indicia of a public service or private membership group.

The particular way in which the pocket square 10 is folded may dictate the configuration and appearance of a ribbon, medal, award or ranking indicia. Thus, for example, if the pocket square is used by a fire department for displaying a logo, ribbon, or citation of the member firefighters during formal occasions, then red stripes may be adorned on a black pocket square, expressing the wearer as a firefighter displayed in FIG. 1 though 4. If the wearer is a military Veteran, stripes shall be displayed and thus the pocket square should be folded in similar fashion to the steps depicted in FIGS. 5 through 9. Alternatively, if the member is Law Enforcement Officer, then the pocket square shall be folded to display blue stripes on a black pocket square as depicted in FIGS. 1 through 4. Thus, the same pocket square 10 may be used to display rankings, citations, or awards of either a captain or a lieutenant, depending on the way in which it is folded.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the disclosed technology.

I claim:

1. A method of folding and donning a pocket square using square piece of a material, said method comprising:

folding a first vertical crease in said piece of material wherein said crease is approximately one-third of a width of said piece of material from a first vertical edge of said piece of material;

folding a second vertical crease in said piece of material wherein said second crease is approximately two-thirds of said width of said piece of material from said first vertical edge of said piece of material;

folding a first horizontal crease in said piece of material wherein said first horizontal crease is between one-fourth and one-third of a distance from a bottom edge to a top edge of said piece of material; and placing said piece of material in a pocket of a jacket or shirt such that an exposed portion of the piece of material is protrudes from said pocket.

2. The method of claim 1, wherein said piece of material is placed in said jacket or suit such that an exposed portion of said piece of material resembles a badge, ribbon, medal, or award worn by a active, or inactive service person.

3. The method of claim 1, wherein said first horizontal crease is formed based on a depth of said pocket.

4. The method of claim 1, wherein said piece of material further comprises a design that is displayed on said exposed portion of said piece of material.

5. The method of claim 1, wherein said piece of material further comprises multiple symbols which are selectively displayed based on said method of folding.

6. The method of claim 5, wherein said piece of material further comprises four identical symbols, of which any number is selectively displayed based on said method of folding.

7. A method of donning a pocket square, said method comprising:

laying out a square fabric, said fabric having a front face, a back face, a top edge, a bottom edge, a left edge, a right edge and a design adorning at least an uppermost portion of said front face or said back face of said fabric;

folding said left edge to a central vertical axis on said front face of said fabric;

folding said right edge to said central vertical axis on said front face of said fabric such that said right edge meets said left edge;

folding said fabric along said central vertical axis;

folding said fabric along a horizontal axis; and placing said fabric in a pocket of a jacket or shirt.

8. The method of claim 7, wherein said horizontal axis is a central horizontal axis.

9. The method of claim 7, wherein an exposed portion of said fabric displays said design.

* * * * *